US005603456A

United States Patent [19]

Akimoto et al.

[11] Patent Number: 5,603,456

[45] Date of Patent: Feb. 18, 1997

[54] LIQUID FUEL BURNER

[75] Inventors: Takamasa Akimoto; Masaki Fujiwara, both of Shiga; Hiroshi Sanui, Kanagawa; Kimio Iino; Hiroshi Igarashi, both of Yamanashi, all of Japan

[73] Assignee: Nippon Sanso Corporation, Tokyo, Japan

[21] Appl. No.: 381,862

[22] PCT Filed: Mar. 2, 1994

[86] PCT No.: PCT/JP94/00334

§ 371 Date: Feb. 7, 1995

§ 102(e) Date: Feb. 7, 1995

[87] PCT Pub. No.: WO94/29645

PCT Pub. Date: Jan. 22, 1994

[30] Foreign Application Priority Data

Jun. 10, 1993 [JP] Japan ..... 5-138636

[51] Int. Cl.[6] ..... B05B 7/06; B05B 7/10

[52] U.S. Cl. ..... 239/406; 239/424

[58] Field of Search ..... 239/406, 405, 239/403, 399, 425, 424.5, 424

[56] References Cited

U.S. PATENT DOCUMENTS

| | | | |
|---|---|---|---|
| 2,551,276 | 5/1951 | McMahan | 239/403 X |
| 3,013,732 | 12/1961 | Webster et al. | 239/406 X |
| 3,979,069 | 9/1976 | Garofalo | 239/405 X |
| 4,216,908 | 8/1980 | Sakurai et al. | 239/406 X |
| 4,261,517 | 4/1981 | Hopkins et al. | 239/406 |
| 4,379,689 | 4/1983 | Morck, Jr. | 239/405 X |

FOREIGN PATENT DOCUMENTS

| | | | |
|---|---|---|---|
| 2396242 | 1/1979 | France . | |
| 2828826 | 1/1979 | Germany . | |
| 197805 | 5/1979 | Germany | 239/406 |
| 30-10056 | 7/1955 | Japan . | |
| 48-5037 | 1/1973 | Japan . | |
| 54-13020 | 1/1979 | Japan . | |

*Primary Examiner*—Lesley D. Morris
*Attorney, Agent, or Firm*—Armstrong, Westerman, Hattori, McLeland & Naughton

[57] ABSTRACT

Disclosed is a burner for burning liquid fuel that is able to obtain a long flame in which the proportion of the luminous flame portion is large, and thereby particularly effective for radiant heat transfer. This liquid fuel burner is composed of a fuel feed pipe (4) having a fuel spray nozzle (3) at its distal end, a combustion-assisting gas feed pipe (6) provided concentrically on the outside of the fuel feed pipe (4) to form a combustion-assisting gas passage (5), and an orifice member (7) arranged within the above-mentioned fuel feed pipe (4) at an interval from the distal end of the fuel feed pipe (4). In addition, the orifice (9) of the orifice member (7) and the fuel spray nozzle (3) of the above-mentioned fuel feed pipe (4) are mutually eccentric.

9 Claims, 5 Drawing Sheets

FIG. 7 (a)
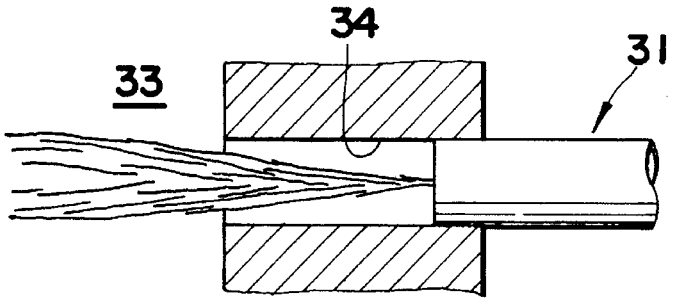
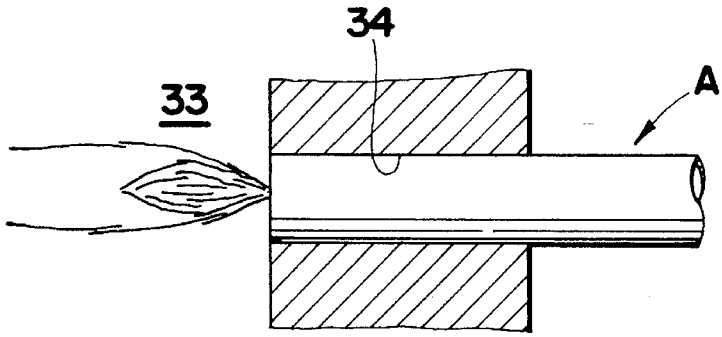
FIG. 7(b)
FIG. 8
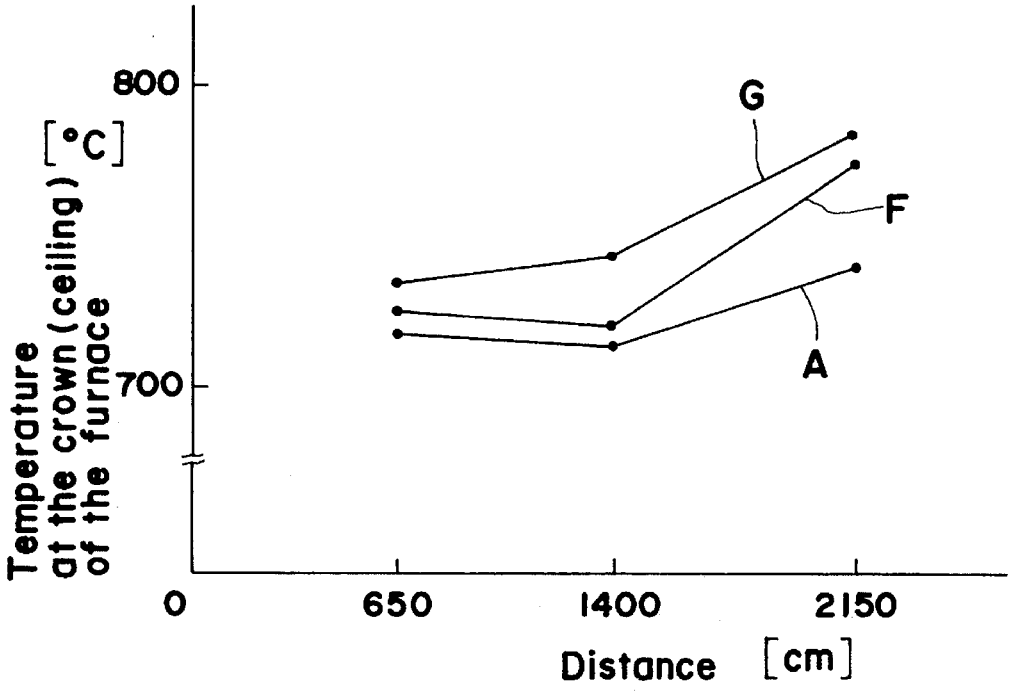

LIQUID FUEL BURNER

TECHNICAL FIELD

The present invention relates to a liquid fuel burner, and more particularly, to a liquid fuel burner suitable for various types of furnaces using radiant heat transfer from a flame, such as a glass melting furnace.

BACKGROUND ART

In glass melting furnaces, a burner has conventionally been used in which a liquid fuel, such as fuel oil or kerosene, is burned in air for uniform temperature rise and heating of the glass. In these furnaces, a melting method is employed whereby the flame is not brought in direct contact with the glass, but rather the glass is heated primarily by transfer of radiant heat.

However, when air is used as the combusting-assisting gas, the volume of exhaust gas increases since nitrogen is contained in the air that does not contribute to combustion. Moreover, the heat loss due to the exhaust gas carried away from the furnace also increases, thus resulting in poor thermal efficiency. In addition, the NOX emission level produced is also very high.

The use of oxygen for the combusting-assisting gas is then considered. When oxygen is used for the combustion-assisting gas, since the amount of combustion exhaust gas is reduced to roughly ⅕ in comparison with that in the case of using air, the amount of heat carried away by the combustion exhaust gas is also reduced to roughly ¼ to ⅕. Together with this resulting in higher thermal efficiency, the amount of NOX produced is also considerably reduced.

However, the flame produced by a conventional liquid fuel burner that uses oxygen gas for the combustion-assisting gas is extremely disadvantageous for use as melting means consisting primarily of radiant heat transfer from the flame. The following provides a detailed description of this.

As disclosed in, for example, the specification of U.S. Pat. No. 4,216,908, liquid fuel gas burners of the prior art that use oxygen gas for the combusting-assisting gas are composed of a fuel feed pipe having a fuel spray nozzle at its distal end, a combusting-assisting gas feed pipe provided concentrically on the outside of said fuel supply pipe to form a combusting-assisting gas passage, a swirler arranged within the above-mentioned fuel supply pipe in close proximity to the above-mentioned fuel spray nozzle, and a plurality of combustion-assisting gas spray nozzles provided continuous with the above-mentioned combustion-assisting gas passage around the above-mentioned fuel spray nozzle.

Together with liquid fuel being sprayed in the form of a mist from the above-mentioned fuel spray nozzle at a large angle of 30 degrees, or more, through the swirler, oxygen gas is flowed from the above-mentioned combustion-assisting nozzles at a velocity of from 50 to 200 m/sec followed by combustion of the sprayed liquid fuel.

With this structure, the liquid fuel is vigorously mixed with the oxygen gas and burned at high speed. As a result, a high-temperature flame having a short flame length is formed producing at a temperature 600° to 800° C. higher than the case of using air. By then directing this high-temperature flame onto the object to be heated, the object to be heated can be heated to a high temperature. Moreover, since the radical substances contained in the flame generate heat when they change to stable substances of carbon dioxide and water after colliding with the object to be heated, the object to be heated can be heated to even higher temperatures.

Thus, although burners of the prior art that use oxygen gas for the combustion-assisting gas are effective for direct heat melting of the object to be heated, since velocity of oxygen gas flowed from the above-mentioned combustion-assisting gas nozzles is rapid, mixing of the liquid fuel and oxygen gas is accelerated. Since the burning velocity becomes correspondingly faster, flame length becomes shorter. Moreover, since the proportion of the luminous flame portion of the flame that is effective in radiant heat transfer is short at about 40 to 60% of flame length (in the case of using a petroleum-based liquid fuel, such as fuel oil or kerosene), there were problems when this is used for melting means consisting primarily of radiant heat transfer from a flame.

Therefore, it is an object of the present invention to provide a liquid fuel burner that is able to increase combustion efficiency to a high level by using gas having an oxygen concentration of 50% or more for the combustion assisting gas, and that is able to obtain a flame that is long and of which a large proportion is composed of a luminous flame portion no be effective in radiant heat transfer, while simultaneously taking advantage of the merit of being able to reduce NOX.

DISCLOSURE OF THE INVENTION

The liquid fuel burner of the present invention is composed of a fuel feed pipe having a fuel spray nozzle at its distal end, a combustion-assisting gas feed pipe provided concentrically on the outside of said fuel feed pipe to form a combustion-assisting gas passage, and an orifice member arranged within the fuel feed pipe at an interval from the distal end of said fuel feed pipe; wherein the orifice of said orifice member and the fuel spray nozzle of the fuel feed pipe are mutually eccentric.

In addition, according to the present invention, there is provided a blade for swirling the combustion-assisting gas in the combusting-assisting gas passage of the combustion-assisting gas feed pipe of an improved fuel gas burner, as described above.

Moreover, in the present invention, the eccentricity ratio as determined by the ratio of the distance between the center line of the fuel spray nozzle and the center line of the orifice to the distance in the axial direction between said fuel spray nozzle and said orifice is 1.0 to 4.0.

In addition, in the present invention, the nozzle velocity of combustion-assisting gas flowed from the combusting-assisting gas passage is 1 to 20 m/sec.

Moreover, the combusting-assisting gas of the present invention has an oxygen concentration of 50% or more.

As described above, according to the liquid fuel burner of the present invention, liquid fuel is sprayed from a fuel spraying nozzle after being diffused in a gap between the orifice member and the distal end of the fuel feed pipe after passing through the orifice. At this time, since the orifice and the fuel spray nozzle are mutually eccentric, the liquid fuel is sprayed from the fuel spray nozzle at a spraying angle smaller than that of the prior art, thus increasing the distance over which the sprayed liquid fuel is projected. On the other hand, the combustion-assisting gas is sprayed from the open end of the combustion-assisting gas passage so as to envelope the atomized liquid fuel. Since the liquid fuel is then burned in this state, a flame is obtained in which the flame length is long and the proportion of the luminous flame portion is large.

The flame length is increased because the liquid fuel that has been projected over a greater distance burns over its entire length as a result of being sprayed at an acute angle from the above-mentioned fuel spray nozzle. The proportion of the luminous portion of the flame is increased because, in the liquid fuel burner of the present invention, the mixing rate of the liquid fuel and combustion-assisting gas is slower than in liquid fuel burners of the prior art in which the liquid fuel is burned all at once. As a result, the manner in which the liquid fuel burns is thought to be less intense. Incidentally, if a gas, such as air having an oxygen gas concentration of less than 50% is used for the combusting-assisting gas, it becomes difficult to completely burn the liquid fuel. Since this results in the production of soot caused by incomplete combustion, in the present invention, it is preferable to use an oxygen-rich gas having an oxygen gas concentration of 50% or more, or high purity oxygen, for the combustion-assisting gas, as described above. This is because a better flame can be formed in the case where the concentration of oxygen higher.

Thus, since the liquid fuel burner of the present invention is able to obtain a flame having a long flame length and a large proportion of luminous flame portion, in the case of being used for glass melting, and so forth, consisting primarily of radiant heat transfer, melting effects are improved and the amounts of liquid fuel and oxygen gas used can be cut down. In addition, since the combustion flame has a narrow spindle-shape, the heat load due to combustion on the end of the burner is reduced. Consequently, it becomes possible to eliminate the need for a water cooling jacket, which was indispensable in liquid fuel burners of the prior art that used oxygen gas.

In addition, the liquid fuel burner of the present invention is concentrically provided with a combustion-assisting gas feed pipe for forming a secondary combustion-assisting gas passage on the outside of the combustion-assisting gas feed pipe for forming a primary combustion-assisting gas passage.

Moreover, in the present invention, the ratio of the flow volume of combusting-assisting gas of the primary combustion-assisting gas passage to the flow volume of the combustion-assisting gas of the secondary combustion-assisting gas passage is 0.25 to 1.0.

In addition, in the present invention, the ratio of the nozzle velocity of combustion-assisting gas of the primary combustion-assisting gas passage to the nozzle velocity of the combustion-assisting gas of the secondary combusting-assisting gas passage is 0.3 to 1.0.

Moreover, in the present invention, the nozzle velocity of the combustion-assisting gas of the primary combustion-assisting gas passage is 10 to 40 m/sec in terms of the state of a temperature of 0° C. and atmospheric pressure of 1 atm.

The liquid fuel burner of the present invention is able to form an even longer combustion flame by providing a combustion-assisting gas feed pipe for forming a secondary combustion-assisting gas passage concentrically on the outside of the combustion-assisting gas feed pipe for forming a primary combustion-assisting gas passage. Moreover, nearly all of the combustion flame is composed of a luminous flame portion, which further improves melting effects in the case of being used for glass melting, and so on, consisting primarily of radiant heat transfer.

BRIEF DESCRIPTION OF THE DRAWINGS

FIG. 7 is a view showing the burner installed in the combustion furnace in Experimental Example 4.

FIG. 8 is a view indicating the relationship between the distance from the open end of the furnace wall at the burner insertion and the temperature at the crown (ceiling) of the furnace in the combustion furnace.

BEST MODE FOR CARRYING OUT THE INVENTION

Figure 1:
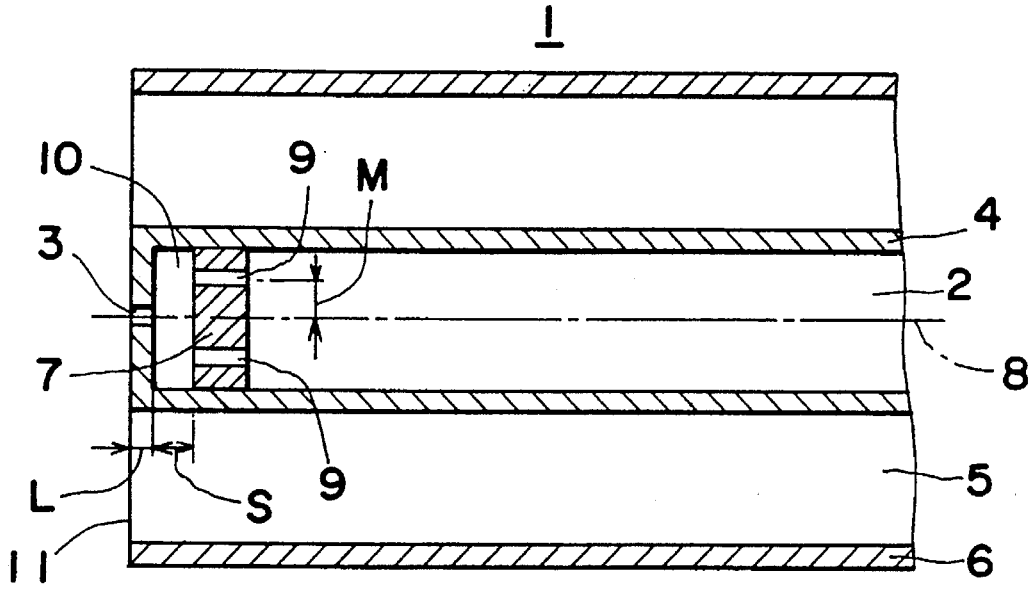
FIG. 1 is a cross-sectional view of the essential portion indicating a first embodiment of the liquid fuel burner of the present invention.

The best mode for carrying out the invention will be described below in detail by referring to the drawings.

FIG. 1 is a cross-sectional view of the essential portion indicating a first embodiment of the liquid fuel burner of the present invention. This liquid fuel burner 1 is composed of a fuel feed pipe 4 having a fuel spray nozzle 3 at the distal end thereof continuous with a fuel passage 2, a combustion-assisting gas feed pipe 6 provided concentrically on the outside of said fuel feed pipe 4 to form a combustion-assisting gas passage 5, and an orifice-containing member 7 arranged within said fuel feed pipe 4 located at an interval from the distal end of said fuel feed pipe 4. The above-mentioned fuel spray nozzle 3 is formed with its axis on a center line 8 of the fuel feed pipe 4. A plurality of orifices 9 in the member 7, for example three, are formed at positions wherein their axes are eccentric to the axis of the fuel spray nozzle 3. The three orifices 9 are each of the same diameter, and are arranged with their axes at equal intervals about the circumference centering on the center line 8.

The interval between the orifice-containing member 7 and the end of the fuel feed pipe 4 serves as a fuel atomization portion 10. The distal end of the combustion-assisting gas passage 5 is a combustion-assisting gas exit port 11.

Various types of liquid fuels can be used for the liquid fuel, examples of which include kerosene, gas oil and fuel oil.

If a gas such as air having an oxygen gas, concentration of less than 50%, is used for the combustion-assisting gas, it becomes difficult to completely combust the liquid fuel. Since soot is produced due to incomplete combustion, in the present invention it is desirable to use an oxygen-rich gas having an oxygen gas concentration of 50% or more, or high purity oxygen, for the combusting-assisting gas. This is because a better flame can be formed in the case where the concentration of oxygen is higher.

According to the above-mentioned constitution, the liquid fuel and combustion-assisting gas are supplied by a known means to passages 2 and 5, respectively. The liquid fuel passes through the orifices 9 and diffuses in the atomization portion 10. Next, it is sprayed from the fuel spray nozzle 3, after which it is combusted after mixing with combustion-assisting gas that flows from the combusting-assisting gas exit port 11 of combustion-assisting gas passage 5.

Although varying slightly according to the length (L) and surface area of the fuel spray nozzle 3, it was experimentally confirmed that the spraying angle of liquid fuel sprayed from said fuel spray nozzle 3 changes mainly according to the ratio of the distance (M) between the center line of the fuel spray nozzle 3 and the center line of the orifice 9, to the distance (S) in the axial direction between said fuel spray nozzle 3 and said orifice 9, namely the gap of fuel atomization portion 10. In other words, this changes according to the value of M/S (referred to as eccentricity). If this eccentricity is less than 1.0, although the projected distance of the fuel increases, since diffusion (atomization) of the liquid fuel sprayed from the above-mentioned fuel spray nozzle 3 becomes inadequate, a portion of the liquid fuel remains unburned. On the other hand, if eccentricity is in excess of 4.0, diffusion of the liquid fuel is good. However, the spraying angle of the liquid fuel increases, resulting in shorter flame length. Based on such findings, by setting eccentricity to within a range of 1.0 to 4.0, the spraying angle of the liquid fuel can be reduced to 5 to 10 degrees while still obtaining adequate diffusion. Thus, a long flame can be obtained.

Figure 2:
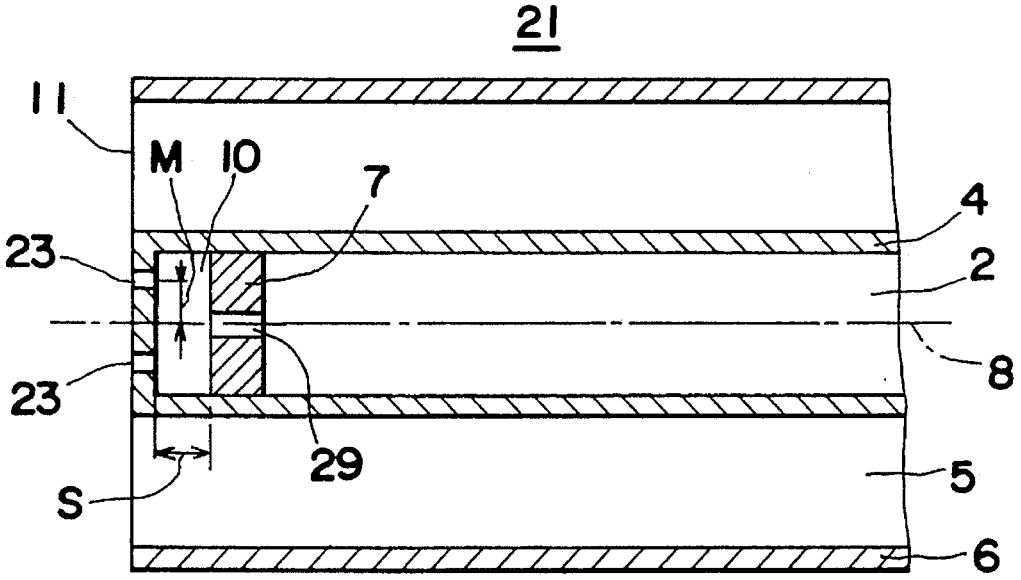
FIG. 2 is a cross-sectional view of essential portion indicating a second embodiment of the present invention.

FIG. 2 is a cross-sectional view of the essential portion indicating a second embodiment of the present invention. In a liquid fuel burner 21 of this embodiment, only the number and positional relationship of fuel spray nozzles 23 of fuel feed pipe 4 and an orifice 29 of orifice member 7 differ from the liquid fuel burner 1 of the first embodiment shown in the above-mentioned FIG. 1. Other constituents are the same as liquid fuel burner 1 of the first embodiment.

The above-mentioned orifice 29 is formed with its axis in the center of the above-mentioned orifice member 7, namely on the center line 8 of the above-mentioned fuel feed pipe 4. A plurality of fuel spray nozzles 23 are formed with their axis at locations eccentric to the above-mentioned orifice 29. This plurality of fuel spray nozzles 23 each have the same diameter, and are arranged at equal intervals about the circumference centering an the above-mentioned center line 8.

Eccentricity in this case is expressed as the ratio of the distance (M) between the center line of the above-mentioned fuel spray nozzles 23 and the center line of the above-mentioned orifice 29, to the distance (S) in the axial direction between said fuel spray nozzles 23 and said orifice 29, namely the gap of fuel atomization portion 10. In other words, this is expressed as M/S.

In the case of this second embodiment as well, by setting eccentricity within a range of 1.0 to 4.0, the spraying angle of the liquid fuel can be reduced to 5 to 10 degrees while still obtaining adequate diffusion. Thus, a long flame can be obtained.

In order to maintain the above-mentioned eccentricity at the prescribed value, either the case of providing one fuel spray nozzle and one orifice, the case of providing a plurality of orifices 9 to one fuel spray nozzle 3, or the case of providing one orifice 29 to a plurality of fuel spray nozzles 23 can be used. In either case, the cross-sectional area of the above-mentioned orifice (total cross-sectional area when using a plurality of orifices) should be made to be larger than the cross-sectional area of the fuel spray nozzle (total cross-sectional area when using a plurality of fuel spray orifices). In the case of providing a plurality of fuel spray nozzles or orifices, it is desirable in terms of forming a good flame to make them all of the same diameter and arrange them at equal intervals on the circumference centering about center line 8. However, as long as eccentricity is set within the prescribed range as described above, even if other conditions change slightly, the same diameter is not used or the fuel spray nozzles and orifices are not arranged at equal intervals, the spraying angle of the fuel burner can be made to be smaller than that of burners of the prior art.

Experimental Example 1

Figure 3A:
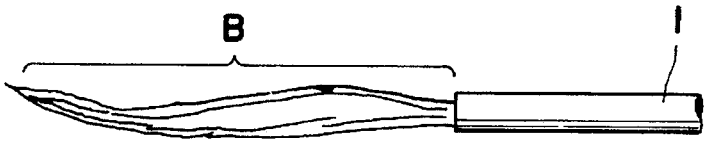
FIG. 3 is an explanatory view indicating the state of the flame in Experimental Example 1.
Figure 3B:
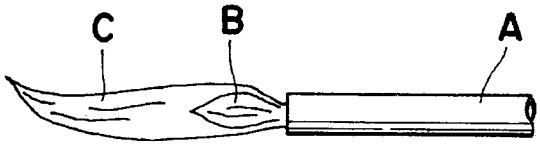

In order to confirm effects according to eccentricity between the above-mentioned fuel spray nozzle 3 and orifices 9, combustion was performed in atmosphere using the liquid fuel burner 1 having the structure shown in FIG. 1 (liquid fuel burner of the present invention) and a liquid fuel burner A of the prior art previously described (liquid fuel burner of the prior art), and the shape of the flame was confirmed. Incidentally, the eccentricity in the liquid fuel burner 1 of the present invention was set at 3.0. Kerosene was allowed to flow into the fuel passage of the above-mentioned burner as liquid fuel at the rate of 50 liters/hour. Oxygen gas (oxygen gas concentration: 98%) was allowed to flow into the combusting-assisting gas passage at the rate of 100 $Nm^3$/hour (where $Nm^3$ will refer to the volume of the gas at a temperature of 0° C. and pressure of 1 atm). Incidentally, since the cross-sectional area of the combusting-assisting gas passages differs between the liquid fuel burner 1 of the present invention and the liquid fuel burner A of the prior art, the nozzle velocity of oxygen gas in the liquid fuel burner 1 of the present invention is 6 m/sec, while that in the liquid fuel burner A of the prior art is 100 m/sec. These results are shown in Table 1. In addition, the states of the flames that were formed are shown in FIG. 3. FIG. 3(*a*) indicates the flame produced by the liquid fuel burner 1 of the present invention, while FIG. 3(*b*) indicates the flame produced by the liquid fuel burner A of the prior art. The temperatures of the flames were determined by measuring the temperature of the luminous flame portion with a radiation thermometer.

TABLE 1

| | Liquid Fuel Burner 1 of the Present Invention | Liquid Fuel Burner A of the Prior Art |
|---|---|---|
| Flame Length (mm) | 2500 | 1500 |
| Length of Luminous Flame Portion (mm) | 2500 | 600 |
| Flame Temperature (°C.) | 2400 | 2700 |

As is clear from the above-mentioned Table 1 and FIG. 3, in the case of liquid fuel burner A of the prior art, the mist of liquid fuel that spreads out from the fuel spray nozzle results in the formation of a flame by being held in by oxygen gas flowing from its outside. Since the liquid fuel and oxygen gas are mixing vigorously, a short flame is obtained having a temperature higher than that of the liquid fuel burner 1 of the present invention. As shown in FIG. 3(*b*), luminous flame portion B was partially formed near the end of the burner, and a long pale blue non-luminous flame portion C, which was thought to be the result of combustion of gas formed by vaporization of the fuel, was formed closer to the end from said luminous flame portion B.

On the other hand, in the case of liquid fuel burner 1 of the present invention, a flame was obtained that was longer than that of the liquid fuel burner A of the prior art, and the luminous flame portion B was extended throughout the entire flame, as shown in FIG. 3(*a*).

As has been described above, according to the liquid fuel burner 1 of the present invention, a favorable flame is obtained having greater radiant heat transfer than liquid fuel burner A of the prior art, and, by controlling the nozzle velocity of combustion-assisting gas flowed from the above-mentioned combustion-assisting gas exit port 11 to within a range of 1 to 20 m/sec, and particularly 2 to 12 m/sec, a flame is obtained that is optimal for practical use. Furthermore, various types of means known in the prior art can be used for the means for controlling the velocity of the combustion-assisting gas, examples of which include adjusting the cross-sectional surface area of the combustion-assisting gas passage according to the amount of combustion-assisting gas used, and providing a flow regulator in the feed pipe to the combustion-assisting gas passage.

Experimental Example 2

Figure 4:
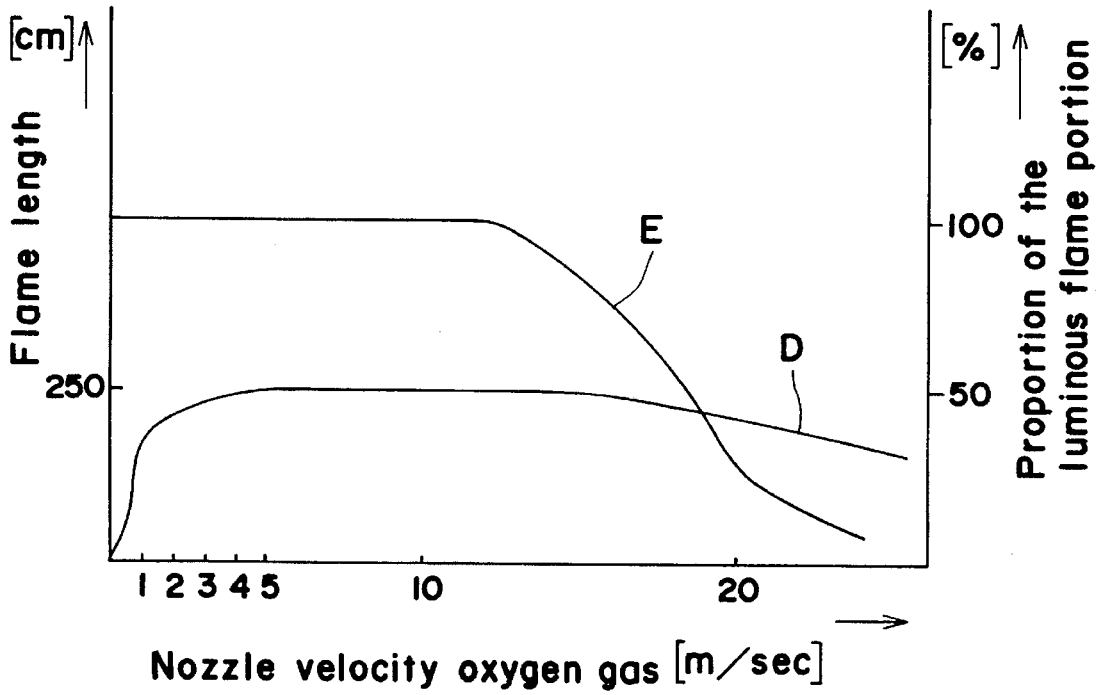
FIG. 4 is a graph indicating the relationship between the nozzle velocity of oxygen gas and the flame in Experimental Example 2.

Next, in order to investigate the relationship between the nozzle velocity of the oxygen gas and the flame, a flame was formed by spraying oxygen gas at various velocities while maintaining the amount of oxygen gas supplied constant and using the liquid fuel burner 1 having the structure shown in FIG. 1 as well as the burners having different surface areas for combustion-assisting gas passage 5. These results are shown in FIG. 4. In this graph, D indicates the length of the flame, and E indicates the proportion of the length of the luminous flame portion to the length of the flame (proportion of the luminous flame portion). Flame length D is plotted on the left vertical axis in centimeters, while the proportion of the luminous flame portion E is plotted on the right vertical axis as a percentage.

As is clear from FIG. 4, when the velocity of oxygen gas is low at less than 1 m/sec, the proportion of the luminous flame portion is high, but the flame is short. This is thought to be due to the velocity of the oxygen gas being excessively slow so that at the distal end of the flame, the state of mixing of liquid fuel and oxygen gas is poor, thus resulting in the production of unburned components. A substantially favorable flame is obtained when the nozzle velocity of oxygen gas is increased to 2 m/sec or more. 0n the other hand, if the nozzle velocity of the oxygen gas is in excess of 12 m/sec, the proportion of the luminous flame portion decreases. In particular, when the nozzle velocity of oxygen gas is increased to a high rate in excess of 20 m/sec, the proportion of the luminous flame portion decreases remarkably, although flame length does not change much. This is thought to be due to the velocity of oxygen being too fast, which results in excessive promotion of mixing of liquid fuel and oxygen gas. As a result, a portion of the liquid fuel is vaporized due to combustion near the distal end of the flame, thus preventing the formation of a luminous flame since the liquid fuel is burned in the vaporized state. Based on the above results, in the case of the liquid fuel burner of the present invention, it is desirable to control the velocity of oxygen gas to 1 to 20 m/sec, and preferably 2 to 12 m/sec, from the viewpoint of practical use.

Figure 5:
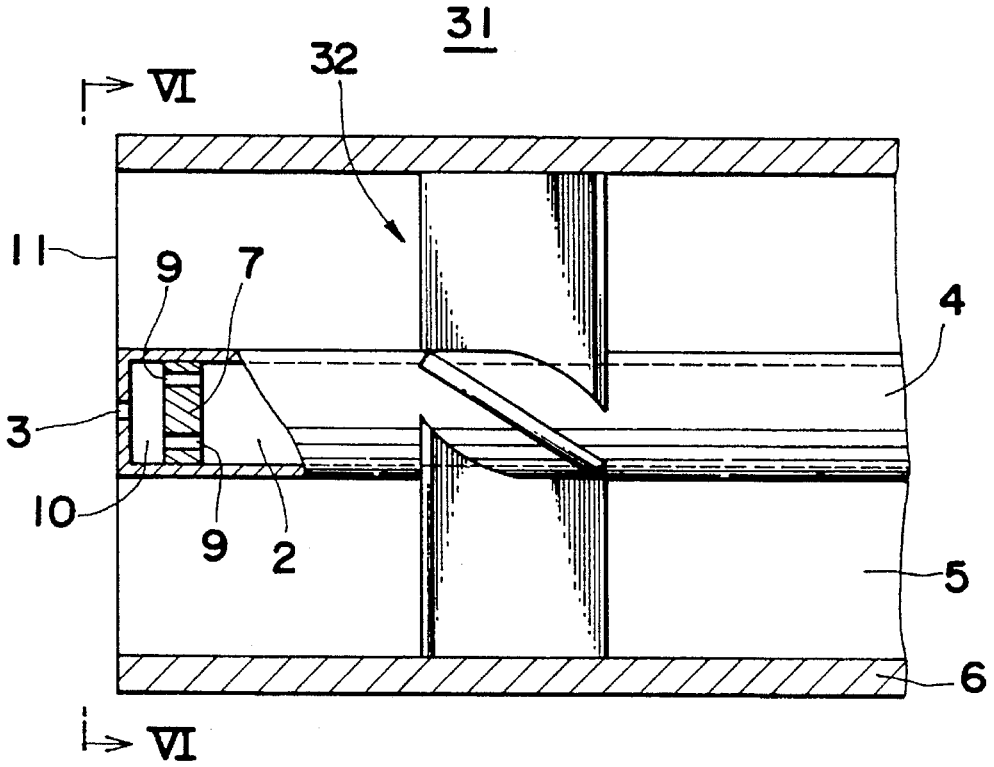
FIG. 5 is a cross-sectional view of the essential portion indicating a third embodiment of the present invention.
Figure 6:
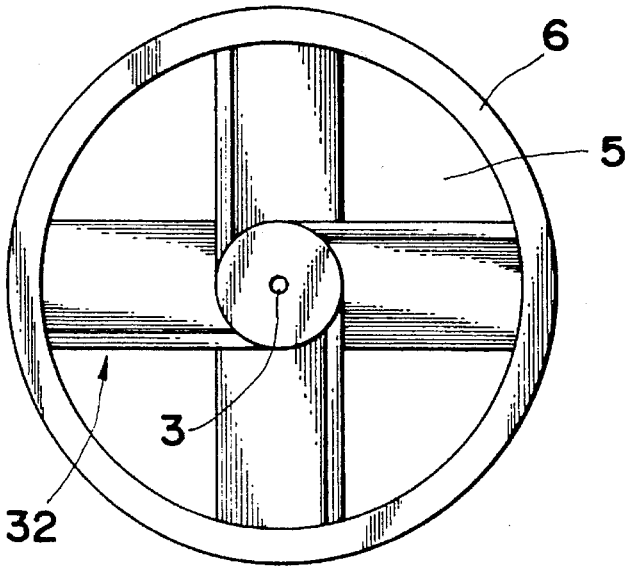
FIG. 6 is a view taken along lines VI—VI of FIG. 5.

Next, FIGS. 5 and 6 indicate a third embodiment of the present invention. FIG. 5 is a cross-sectional view depicting the pipe on the outside that forms the combustion assisting gas passage 5 cut away. FIG. 6 is a view taken along lines VI—VI shown by arrows in FIG. 5.

A liquid fuel burner 31 of this embodiment is provided with a blade 32 for swirling the combustion-assisting gas in the above-mentioned combustion-assisting gas passage 5 of combustion-assisting gas feed pipe 6. Other constituents are the same as the liquid fuel burner 1 of the first embodiment.

As shown in FIG. 6, the above-mentioned blade 32 for swirling the combustion-assisting gas is composed of four blade elements. These four blade elements are arranged at equal intervals within the combustion-assisting gas passage 5, and have a prescribed angle with respect to said combustion-assisting gas passage 5. Incidentally, although 4 blade elements are used in this example, any number of blade elements can be used.

As a result of employing the above-mentioned constitution, combustion-assisting gas flowing through the combustion-assisting gas passage 5 is subjected to swirling force when it passes between each of the blade elements of blade 32, and is flowed out in the swirled state from the combustion-assisting gas spray pore 11. As a result, although flame length hardly changes at all, a combustion flame is produced that has a luminous flame portion with high-temperature, thus improving radiant heat transfer effects. This is thought to be due to the combustion-assisting gas subjected to this swirling force being mixed with liquid fuel while swirling around the liquid fuel that has been atomized and sprayed from the fuel spray nozzle 3, thus enabling suitable mixing with the liquid fuel.

Experimental Example 3

Next, the effect of blade 32 was confirmed by using the liquid fuel burner of the third embodiment, setting the conditions for the velocity of the liquid fuel and combustion-assisting gas to be the same as in Experimental Example 1, and changing the inclination of the blade elements of blade 32 with respect to the combustion-assisting gas passage 5. The above-mentioned inclination of the blade elements was defined such that an inclination of 0 degrees corresponds to the state in which the blade elements are parallel with the combustion-assisting gas passage 5, while an inclination of 90 degrees corresponds to the state in which the blade elements are perpendicular to the combustion-assisting gas passage 5. These results are shown in Table 2.

TABLE 2

| Inclination (°) | 0 | 20 | 40 |
|---|---|---|---|
| Flame Length (mm) | 2500 | 2500 | 2450 |
| Length of Luminous Flame Portion (mm) | 2500 | 2500 | 2450 |
| Flame Temperature (°C.) | 2400 | 2450 | 2500 |

As is clear from Table 2, the results are the same as those of the burner of FIG. 1 when the inclination is 0 degrees. When the inclination is increased to 20 and 40 degrees, both flame length and the luminous flame portion remain almost the same with the temperature of the flame increasing. When the inclination is increased to 45 degrees and beyond, however, there is essentially no change. In this case, it becomes necessary to increase the supply pressure of the oxygen gas, since the blade 32 becomes an opposition to the flow of oxygen gas. Thus, it is preferable that the inclination of the above-mentioned blade elements be set to a suitable value of 40 degrees or less corresponding to the actual conditions of use.

Incidentally, since Experimental Examples 1 through 3 described above were conducted in atmosphere, the distal end of the flame was pointing upward due to buoyancy, as shown in FIG. 3. In the case of use in an actual furnace, however, due to the high temperature inside the furnace, the difference between the temperature inside the furnace and the temperature of the flame is small. Thus, buoyancy is reduced resulting in the obtaining of a substantially horizontal flame.

Experimental Example 4

Subsequently, a burner in which the inclination of the above-mentioned blade elements was set to 0 degrees and a burner in which the inclination of the above-mentioned blade elements was set to 40 degrees were installed in a test combustion furnace, and the temperature inside the furnace was measured. The liquid fuel burner A of the prior art used in Experimental Example 1 was used for comparison purposes.

The state of flame formation differs between the burner 31 as an embodiment of the present invention and the burner A of the prior art as shown in FIG. 3. Thus, in the case of burner 31, in contrast to the distal end of the burner being able to be arranged towards the outside of a burner insertion port 34 continuous with the inside of a furnace 33 as shown in FIG. 7(*a*), it must be inserted to the back of burner insertion port 34 in the case of liquid fuel burner A of the prior art. Consequently, it is necessary to provide a water cooling jacket that is water-cooled, for example, on the outer periphery of the end of the burner in liquid fuel burner A of the prior art so as not to subject the burner tiles affixed to the inside wall of the burner insertion port 34 to wear. In contrast, in the case of burner 31, as a result of forming a long, thin flame, the heat load of the distal end of the burner caused by combustion is reduced, thus offering the advantage of eliminating the need to cool the vicinity of the end of the burner.

FIG. 8 is a graph that resulted from forming a flame using a burner F with the inclination of the above-mentioned blade elements set to 0 degrees, a burner G with the inclination of the above-mentioned blade elements set to 40 degrees, and the burner A of the prior art, and then measuring the temperature at the crown (ceiling) of the furnace at a prescribed location from the end of the opening of the furnace of burner insertion port 34. As is clear from FIG. 8, the temperature inside the furnace can be seen to increase in the order of burner A of the prior art, the burner F and the burner G.

Figure 9:
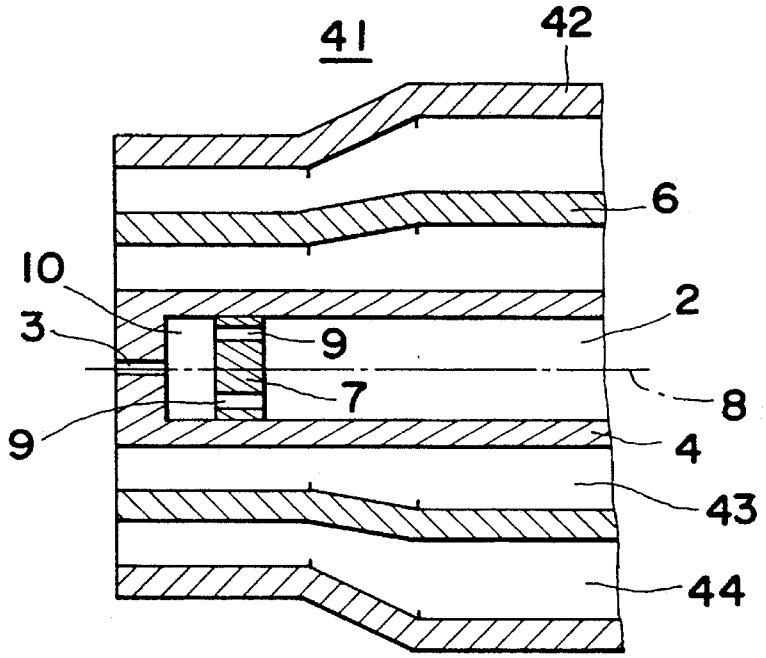
FIG. 9 is a cross-sectional view of the essential portion indicating a fourth embodiment of the present invention.

FIG. 9 is a cross-sectional view of the essential portion of a liquid fuel burner indicating a fourth embodiment of the present invention.

A liquid fuel burner 41 of this embodiment is provided concentrically with a second combustion-assisting gas feed pipe 42 on the outside of the above-mentioned combustion-assisting gas feed pipe 6 of the burner of the first embodiment. Other constituents are the same as those of liquid fuel burner 1 of the first embodiment.

A primary combustion-assisting gas passage 43 is then formed between the above-mentioned fuel feed pipe 4 and the combustion-assisting gas feed pipe 6, while a secondary combustion-assisting gas passage 44 is formed between the above-mentioned combustion-assisting gas feed pipe 6 and the above-mentioned combustion-assisting gas feed pipe 42.

Figure 10:
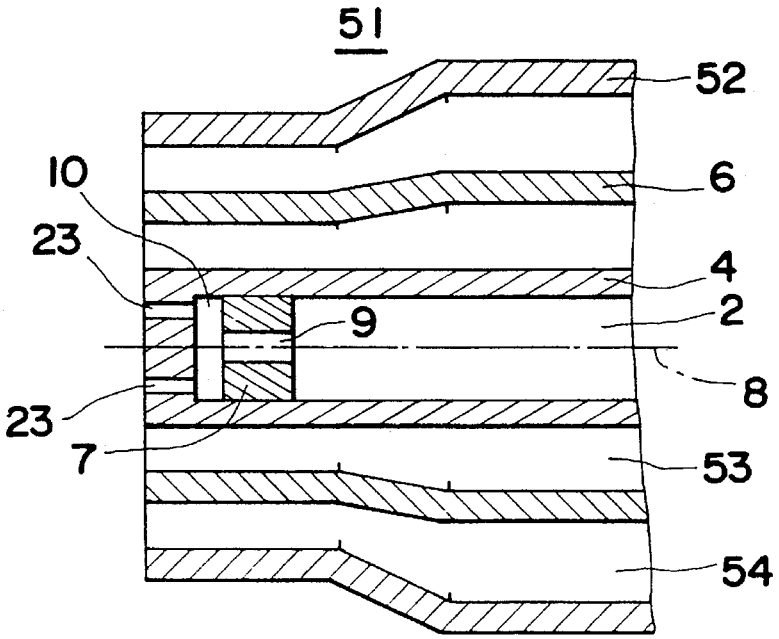
FIG. 10 is a cross-sectional view of the essential portion indicating a fifth embodiment of the present invention.

FIG. 10 is a cross-sectional view of the essential portion of a liquid fuel burner indicating a fifth embodiment of the present invention.

A liquid fuel burner 51 of this embodiment is provided concentrically with a second combustion-assisting gas feed pipe 52 on the outside of the above-mentioned combustion-assisting gas feed pipe 6 of the burner of the second embodiment. Other constituents are the same as those of liquid fuel burner 21 of the second embodiment.

A primary combustion-assisting gas passage 53 is then formed between the above-mentioned fuel feed pipe 4 and the combustion-assisting gas feed pipe 6, while a secondary combustion-assisting gas passage 54 is formed between the above-mentioned combustion-assisting gas feed pipe 6 and the above-mentioned combustion-assisting gas feed pipe 52.

By providing a secondary combustion-assisting gas passage on the outer periphery of a primary combustion-assisting gas passage as described above, a primary combustion-assisting gas flow sprayed from the primary combustion-assisting gas passage is formed around fuel sprayed at a small angle from the fuel spray nozzle, while a secondary combustion-assisting gas flow sprayed from the secondary combustion-assisting gas passage is formed around said primary combustion-assisting gas flow. As a result, a long flame having a large luminous flame portion is obtained. In addition, the length of the flame can be changed by changing the ratios of flow volume and velocity between the primary combusting-assisting gas flow and secondary combustion-assisting gas flow.

It should be noted that the above-mentioned ratios of the flow volume and velocity are defined as the ratio of the primary combustion-assisting gas flow to the secondary combustion-assisting gas flow, namely [primary]/[secondary].

An experimental example using a liquid fuel burner as a fourth embodiment of the present invention shown in FIG. 9 will be given below.

Experimental Example 5

Combustion properties in the case of changing the flow volume when kerosene at 35 liters/hour and oxygen at 70 $Nm^3$/hour were burned in atmosphere were as shown in Table 3. Incidentally, the oxygen velocity on the primary side was 20 Nm/sec (where Nm is to indicate the value converted for a temperature of 0° C. and pressure of 1 atm, the same shall apply hereinafter) and that on the secondary side was 33 Nm/sec.

TABLE 3

| | Flow Volume Ratio | | | | |
|---|---|---|---|---|---|
| | 0.11 | 0.25 | 0.54 | 1.00 | 2.33 |
| Flame Length (mm) | Large unburned portion | 1500 | 1700 | 1500 | 1200 |
| Luminous Flame Portion (mm) | | 1500 | 1700 | 1500 | 1200 |
| Flame Temperature (max, °C.) | 2100 | 2400 | 2500 | 2550 | 2600 |

Based on the above results, it is preferable to set the flow volume ratio to within a range of 0.25 to 1.0, and particularly to roughly 0.54. Incidentally, when the oxygen burner of the prior art was used under the same conditions, flame length was 900 mm, the luminous flame portion was 600 mm, and the maximum flame temperature was 2700° C.

Experimental Example 6

Combustion properties in the case of changing velocity while setting the flow volume ratio in Experimental Example 5 to 0.54 were as shown in Table 4. In this case, the primary oxygen velocity was 20 Nm/sec.

TABLE 4

| | Velocity Ratio | | | | | | | | |
|---|---|---|---|---|---|---|---|---|---|
| | 0.1 | 0.2 | 0.3 | 0.5 | 0.6 | 0.8 | 1.0 | 1.2 | 1.5 |
| Flame Length (mm) | Large unburned portion | 1100 | 1500 | 1600 | 1700 | 1700 | 1600 | 1200 | 1100 |
| Luminous Flame Portion (mm) | | 1050 | 1500 | 1600 | 1700 | 1700 | 1600 | 1100 | 1000 |
| Flame Temp. (°C.) | 2100 | 2300 | 2400 | 2500 | 2500 | 2500 | 2550 | 2600 | 2650 |

Based on the above results, it is preferable to set the velocity ratio to within a range of 0.3 to 1.0, and particularly to 0.6 to 0.8.

Experimental Example 7

Combustion properties in the case of varying the primary oxygen velocity while setting the flow volume ratio in Experimental Example 5 to 0.54 were as shown in Table 5. Incidentally, secondary oxygen velocity was varied over the application range of 0.3 to 1.0 for the velocity ratios confirmed in Experimental Example 6.

TABLE 5

| | | | | | | | |
|---|---|---|---|---|---|---|---|
| Primary Oxygen Velocity | 5 | 10 | 20 | 40 | 50 | 60 | 70 |
| Secondary Oxygen Velocity Range | 5–17 | 10–33 | 20–67 | 40–133 | 50–150 | 60–150 | 70–150 |
| Primary/Secondary Flow Volume Ratio | 0.3–1 | 0.3–1 | 0.3–1 | 0.3–1 | 0.33–1 | 0.4–1 | 0.46–1 |
| Flame Length (mm) | 1200–1300 | 1450–1700 | 1500–1700 | 1400–1600 | 1200–1300 | 1100–1200 | 900–1000 |
| Flame Luminous Portion (mm) | 1200–1300 | 1450–1700 | 1500–1700 | 1400–1600 | 1200–1300 | 1000–1200 | 900–1000 |
| Flame Temperature (°C.) | 2100–2200 | 2400–2500 | 2400–2550 | 2450–2550 | 2500–2650 | 2600–2700 | 2600–2700 |

* Units for the range of primary oxygen velocity and secondary oxygen veloxity are Nm/sec.

Based on the above results, it is preferable to set the primary oxygen velocity to within a range of 10 to 40 Nm/sec, and particularly to 10 to 20 Nm/sec.

As has been mentioned above, the liquid fuel burners of the fourth and fifth embodiments are able to realize a low angle of spraying of liquid fuel by employing a structure providing the above-mentioned fuel atomization portion 10 and a primary combustion-assisting gas passage and secondary combusting-assisting gas passage concentrically on the outer periphery of said atomization portion 10. Moreover, they are also able to obtain preferable combustion properties by controlling a combustion-assisting gas supply means. Namely, the flow volume ratio is controlled to within a range of 0.25 to 1.0, the velocity ratio is controlled to within a range of 0.3 to 1.0, and the primary combustion-assisting gas velocity is controlled to within a range of 10 to 40 Nm/sec.

We claim:

1. A liquid fuel burner composed of a fuel feed pipe having a fuel spray nozzle at a distal end, a combustion-assisting gas feed pipe disposed concentrically about said fuel feed pipe to cooperate therewith to form a combustion-assisting gas passage, and a member containing an orifice disposed within said fuel feed pipe in spaced relation from said fuel spray nozzle wherein the center line of said orifice of said member and the center line of said fuel spray nozzle of said fuel feed pipe are mutually parallel and eccentric.

2. The liquid fuel burner as set forth in claim 1 including a blade for swirling combustion-assisting gas disposed in the combustion-assisting gas passage.

3. The liquid fuel burner as set forth in claim 1 wherein eccentricity between the center lines of said orifice and said fuel spray nozzle as determined by the ratio of the distance between the center line of said fuel spray nozzle and the center line of said orifice to the distance in the axial direction between said fuel spray nozzle and said orifice is 1.0 to 4.0.

4. The liquid fuel burner as set forth in claim 1 wherein a nozzle velocity of combustion-assisting gas sprayed from said combustion-assisting gas passage is 1 to 20 m/sec.

5. The liquid fuel burner as set forth in claim 1 wherein said combustion-assisting gas has an oxygen concentration of 50% or more.

6. The liquid fuel burner as set forth in claim 1 wherein a combustion-assisting gas feed pipe for forming a secondary combustion-assisting gas passage is concentrically disposed about the outside of said combustion-assisting gas feed pipe for forming a primary combusting-assisting gas passage.

7. The liquid fuel burner as set forth in claim 6 wherein a flow volume ratio of combustion-assisting gas passage to combustion-assisting gas of said secondary combustion-assisting gas passage is 0.25 to 1.0.

8. The liquid fuel burner as set forth in claim 6 wherein a velocity ratio of combustion-assisting gas of the primary combustion-assisting gas passage to combustion-assisting gas of said secondary combustion-assisting gas passage is 0.3 to 1.0.

9. The liquid fuel burner as set forth in claim 6 wherein a velocity of the combustion-assisting gas of said primary combustion-assisting gas passage is 10 to 40 m/sec when converted to a temperature of 0° C. and atmospheric pressure of 1 atm.

* * * * *